US009938064B2

(12) United States Patent
Umenaka et al.

(10) Patent No.: US 9,938,064 B2
(45) Date of Patent: Apr. 10, 2018

(54) CHECK VALVE, CHECK VALVE ASSEMBLY AND VESSEL EQUIPPED WITH CHECK VALVE

(71) Applicant: Hosokawa Yoko Co., LTD., Tokyo (JP)

(72) Inventors: Kazuhiro Umenaka, Tokyo (JP); Yuichiro Moriyama, Toyama (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 56 days.

(21) Appl. No.: 14/916,124

(22) PCT Filed: Sep. 3, 2014

(86) PCT No.: PCT/JP2014/073259

§ 371 (c)(1),
(2) Date: Mar. 2, 2016

(87) PCT Pub. No.: WO2015/033983

PCT Pub. Date: Mar. 12, 2015

(65) Prior Publication Data

US 2016/0214780 A1 Jul. 28, 2016

(30) Foreign Application Priority Data

Sep. 4, 2013 (JP) ..... 2013-183087

(51) Int. Cl.
*B65D 25/40* (2006.01)
*B65D 75/58* (2006.01)
(Continued)

(52) U.S. Cl.
CPC ..... *B65D 75/5883* (2013.01); *B65D 47/06* (2013.01); *B65D 47/123* (2013.01);
(Continued)

(58) Field of Classification Search
CPC ..... B65D 47/2018; B65D 47/2056; B65D 47/2062; B65D 47/2068; B65D 47/2075;
(Continued)

(56) References Cited

U.S. PATENT DOCUMENTS 1,716,802 A * 6/1929 Stevenson ..... B65D 47/2075 222/495
1,862,794 A * 6/1932 Lamb ..... B65D 47/2075 137/512.5
(Continued)

FOREIGN PATENT DOCUMENTS

CH 95485 A 7/1922
JP S53522 1/1978
(Continued)

OTHER PUBLICATIONS

European Patent Office, Extended European Search Report, Application No. 14842031.8, dated Apr. 20, 2017.
(Continued)

*Primary Examiner* — J. Casimer Jacyna
(74) *Attorney, Agent, or Firm* — Quarles & Brady LLP

(57) ABSTRACT

A check valve of one embodiment includes a spout member which has a flow path inside, an urging member supported by an inner end portion of the spout member, a valve body connected to the urging member, and a cylindrical member having a flow path inside, and is provided with a valve seat portion on an inner circumferential face, the spout member is fixedly attached to the cylindrical member so that the valve body and the urging member are inserted into the cylindrical member and the valve body is urged to the valve seat portion by the urging member, and the flow path and the flow path communicate with each other to configure an outflow path through which the content in the vessel flows out.

7 Claims, 7 Drawing Sheets

(51) Int. Cl.
*B65D 47/20* (2006.01)
*B65D 47/24* (2006.01)
*B65D 47/12* (2006.01)
*B65D 47/06* (2006.01)

(52) U.S. Cl.
CPC ..... *B65D 47/2018* (2013.01); *B65D 47/2056* (2013.01); *B65D 47/2068* (2013.01); *B65D 47/2075* (2013.01); *B65D 47/2081* (2013.01); *B65D 47/247* (2013.01); *B65D 47/248* (2013.01); *B65D 47/24* (2013.01)

(58) Field of Classification Search
CPC ..... B65D 47/2081; B65D 47/2087; B65D 47/04; B65D 47/06; B65D 47/123; B65D 47/24; B65D 47/245; B65D 47/247; B65D 47/248; B65D 75/5883
See application file for complete search history.

(56) References Cited

U.S. PATENT DOCUMENTS

| | | | | |
|---|---|---|---|---|
| 9,422,100 | B2 * | 8/2016 | Uetake | B65D 47/18 |
| 2003/0047572 | A1 | 3/2003 | Masuda | |
| 2008/0063319 | A1 | 3/2008 | Kuge et al. | |
| 2014/0183154 | A1 * | 7/2014 | Essebaggers | B65D 47/32 215/311 |
| 2015/0216723 | A1 * | 8/2015 | Yoshimura | B65D 47/18 604/295 |
| 2016/0375452 | A1 * | 12/2016 | Skillin | B05B 11/047 222/207 |
| 2017/0107024 | A1 * | 4/2017 | Tamarindo | B65D 47/2075 |

FOREIGN PATENT DOCUMENTS

| | | | |
|---|---|---|---|
| JP | S628937 | U | 1/1987 |
| JP | S6394153 | U | 6/1988 |
| JP | H06278758 | A | 10/1994 |
| JP | H0680655 | U | 11/1994 |
| JP | H07277353 | A | 10/1995 |
| JP | H09240701 | A | 9/1997 |
| JP | 2004131159 | A | 4/2004 |
| JP | 2006-76615 | A | 3/2006 |
| JP | 2006264759 | A | 10/2006 |
| JP | 2009078848 | A | 4/2009 |
| JP | 2014118195 | A | 6/2014 |
| KR | 1020090086736 | A | 8/2009 |

OTHER PUBLICATIONS

Office Action dated Sep. 15, 2017 from Japanese Patent Application No. 2013-183087, 8 pages.

* cited by examiner

CHECK VALVE, CHECK VALVE ASSEMBLY AND VESSEL EQUIPPED WITH CHECK VALVE

CROSS-REFERENCE TO RELATED APPLICATIONS

This application represents the 371 national stage entry of PCT International Application PCT/JP2014/073259 filed Sep. 3, 2014 and is based upon and claims the benefit of priority from Japanese Patent Application 2013-183087, filed Sep. 4, 2013, the entire contents of all of which are incorporated herein by reference.

TECHNICAL FIELD

The present invention relates to a check valve, a check valve assembly and a vessel equipped with the check valve. More particularly, the present invention relates to a check valve for pouring a content in a vessel, a check valve assembly having the check valve, and a vessel equipped with the check valve in which the check valve assembly is attached to a pouring portion.

BACKGROUND ART

Conventionally, vessels having pourers have been used for various use purposes. As a kind of vessel like them, there is known a spout pouch with a pourer (spout) attached to a packaging bag (pouch). In recent years, as a result of widespread proliferation of the spout pouches, various contents have come to be filled in spout pouches.

When the contents to be filled are soy sauce, edible oil, and alcoholic drinks, the contents are preferably prevented from contacting oxygen in the air as much as possible in order to prevent deterioration by oxidation. Consequently, in order not to suck external air directly after pouring a content, a vessel equipped with a check valve in which the check valve is incorporated in the pourer is demanded.

Patent Literature 1 describes the check valve having a mechanism that closes the valve by using a restoring force of an urging member (a coil spring or the like), as the check valve applicable to a vessel equipped with the check valve. In the check valve, a spool (a shaft portion) that is connected to a valve body engages with the urging member. The valve body is urged toward a seat face of a valve seat portion by the urging member, via the spool.

In the check valve of this kind, at the time of pouring a content, the vessel main body such as a packaging bag is pressed by hand. Thereby, the valve body is separated from the valve seat portion against the urging force of the urging member with the internal pressure of the vessel, and the valve is opened. At the time of stopping pouring of the content, compression to the vessel main body is stopped. Thereby, the valve body is seated on the valve seat portion by the restoring force of the urging member, and the valve is closed.

CITATION LIST

Patent Literature

Patent Literature 1: Japanese Patent Laid-Open No. 2006-76615

SUMMARY OF INVENTION

Technical Problem

The check valve described in Patent Literature 1 described above has several problems as described below.

The check valve described in Patent Literature 1 needs the spool for transmitting the urging force to the valve body as described above, and therefore cannot help having a complicated configuration.

Further, in the check valve described in Patent Literature 1, there is nothing that blocks the urging member from the vessel main body between the urging member and the vessel main body, and the urging member is always in a state contactable to the content. Consequently, even when the check valve is attached to a side portion or a bottom portion of the vessel main body, or the check valve is attached to a ceiling portion of the vessel main body, for example, if the vessel is used or stored horizontally or with bottom up, the components of the content are likely to deposit on the urging member.

When the content is soy sauce or an alcoholic drink, for example, crystal of salt, sugar or the like readily deposits on the urging member and is solidified. When deposits hinder movement of the urging member by filling the gap in the coil spring, or the like, there arises the problem that the check valve function is reduced, the content cannot be normally poured, and sealing performance of the vessel is reduced.

Further, in the check valve described in Patent Literature 1, the valve body is provided in the nearest neighborhood of the pouring port, and therefore, when the valve opens, the content suddenly spatters from the pouring port. Consequently, there is also the problem that pouring the content into a desired pouring destination such as a cup is difficult.

The present invention is made on the basis of the above described technical recognition, and an object of the present invention is to provide a check valve capable of preventing reduction in a check valve function by deposition of a content as much as possible, and easily pouring the content into a desired pouring destination.

Solution to Problem

A check valve according to the present invention is a check valve including a valve member including a spout member with a pouring port of a vessel provided at an outer end portion, an urging member with a base end portion supported by an inner end portion of the spout member, and a valve body connected to a tip end portion of the urging member, and a cylindrical member with a valve seat portion on which the valve body is seated to be capable of hermetically sealing provided on an inner circumferential face, inside the spout member, a first flow path in which a content in the vessel flows is provided, inside the cylindrical member, a second flow path through which the content in the vessel flows is provided, and the first flow path and the second flow path communicate with each other to configure an outflow path through which the content in the vessel flows out, and the spout member is fixedly attached to the cylindrical member so that the valve body and the urging member are inserted into the cylindrical member, and the valve body is urged to the valve seat portion by the urging member.

Further, in the check valve, the valve body may have a guided portion that restricts movement of the valve body, at an upstream side in the outflow path, and the cylindrical member may have a guide portion that causes the guided member to slide in a central axis direction of the valve body, at an upstream side in the outflow path, of the valve seat portion.

Further, in the check valve, the spout member, the urging member and the valve body may be integrally molded.

A check valve assembly according to the present invention includes the check valve according to the present invention, and a reinforcing casing that prevents deformation of the valve seat portion, the reinforcing casing is internally provided with a hollow portion in which the cylindrical member is incorporated, and has a seal portion that is bonded to a vessel main body, on an outer surface.

A vessel equipped with a check valve according to the present invention includes the check valve assembly according to the present invention, and a vessel main body that contains a content, and has the check valve assembly attached to a pouring portion.

Advantageous Effects of Invention

In the check valve according to the present invention, the urging member is disposed at the pouring port side (the downstream side in the outflow path) from the valve body, and therefore, in a state where the valve is closed, the urging member is shut off from the content. Thereby, the components included in the content are restrained from depositing on the urging member. As a result, the content can be normally poured, and the check valve function of keeping sealing performance of the vessel can be kept when the content is not poured.

Consequently, according to the present invention, reduction of the check valve function by deposition of the content can be prevented as much as possible.

Furthermore, in the check valve according to the present invention, the content passing through the valve body is rectified by the outflow path of a length of a length of the urging member or more. Consequently, the content can be prevented from suddenly spattering from the pouring port when the valve is opened.

Consequently, according to the present invention, the content can be easily poured into a desired pouring destination.

As described above, according to the present invention, reduction in the check valve function by deposition of the content can be prevented as much as possible, and the content can be easily poured into the desired pouring destination.

DESCRIPTION OF EMBODIMENT

Hereinafter, an embodiment according to the present invention will be described with reference to the drawings. Note that components having equivalent functions in the respective drawings are assigned with the same reference signs, and detailed explanation of the components with the same reference signs is not repeated.

<Check Valve>

A check valve 1 according to one embodiment of the present invention will be described with use of FIG. 1 and FIG. 2.

Figure 1:
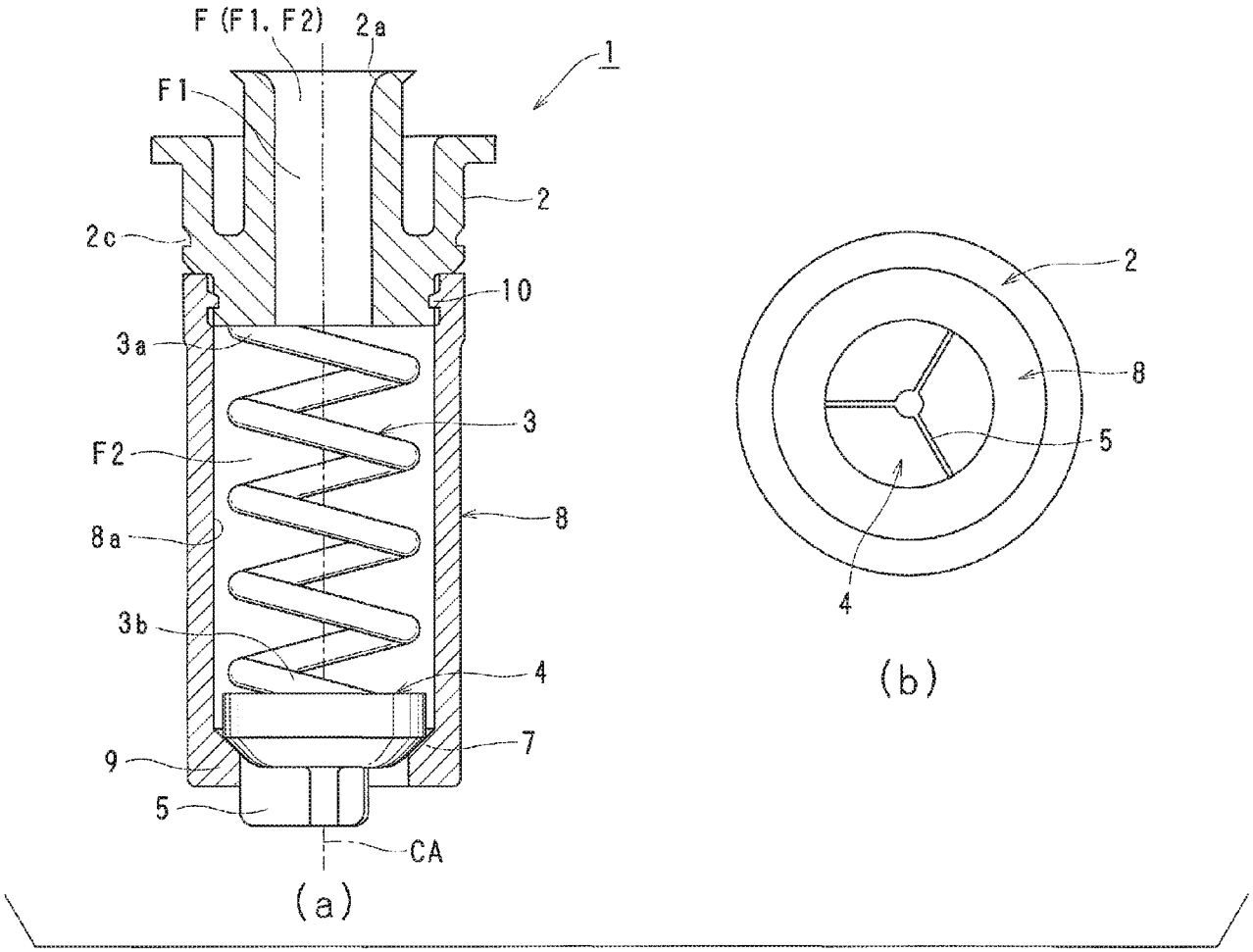
FIG. 1(*a*) is a partial sectional view of a check valve according to one embodiment of the present invention, and FIG. 1(*b*) is a bottom view of the check valve.

FIG. 1(*a*) is a partial sectional view of the check valve 1 according to one embodiment. In FIG. 1(*a*), a spout member 2 and a cylindrical member 8 are shown in a sectional view, and the other components are shown in a side view. FIG. 1(*b*) is a bottom view of the check valve 1.

Figure 2:
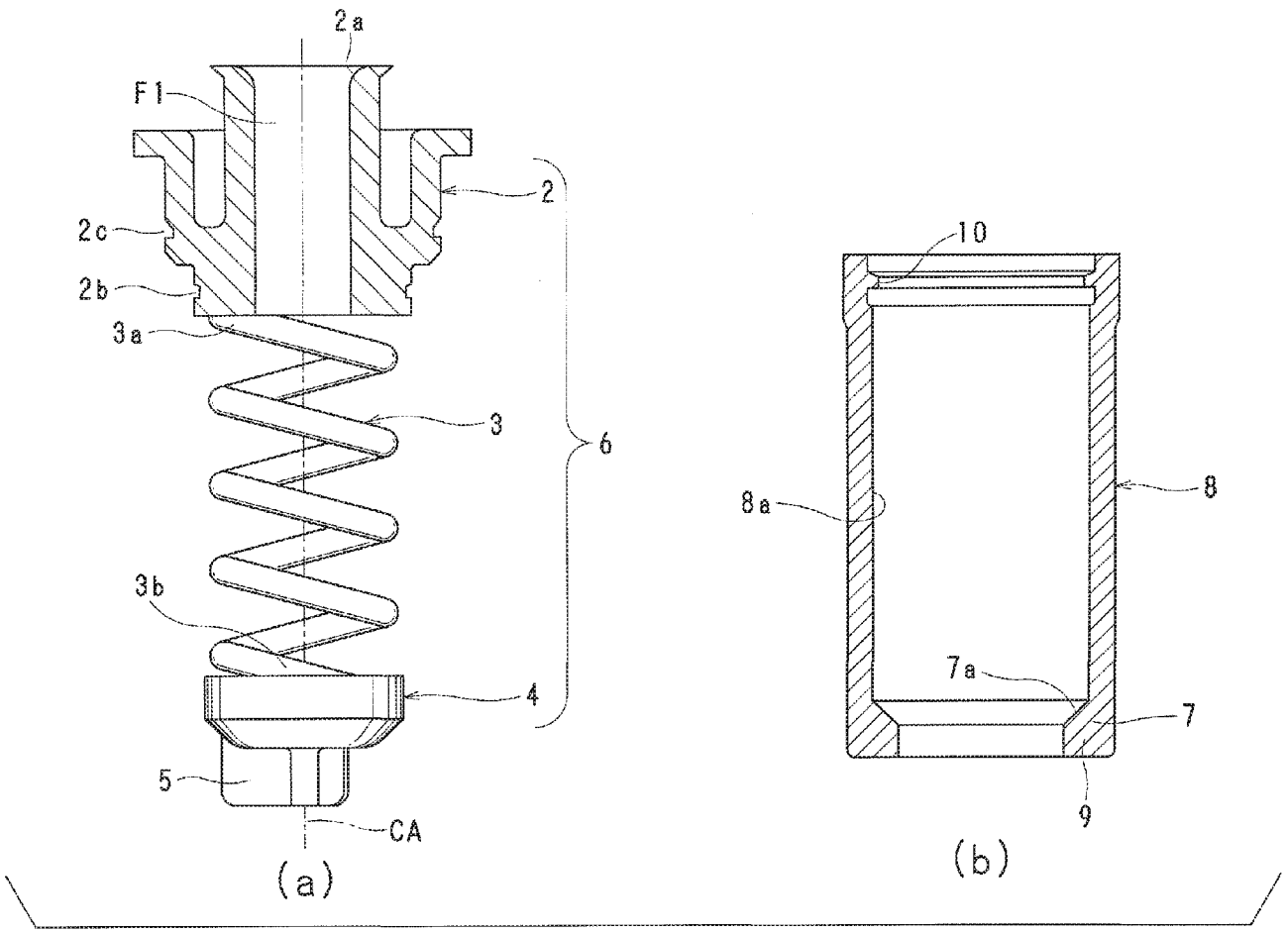
FIG. 2(*a*) is a partial sectional view of a valve member of the check valve according to one embodiment, and FIG. 2(*b*) is a sectional view of a cylindrical member of the check valve according to one embodiment.

FIG. 2(*a*) is a partial sectional view of a valve member 6 of the check valve 1. In FIG. 2(*a*), only the spout member 2 is shown in a sectional view, and the other components are shown in a side view. FIG. 2(*b*) is a sectional view of the cylindrical member 8 of the check valve 1 by a plane passing through a central axis CA.

As shown in FIG. 1(*a*), the check valve 1 includes the spout member 2, an urging member 3, a valve body 4 and the cylindrical member 8. The spout member 2, the urging member 3 and the valve body 4 configure the valve member 6. Note that the spout member 2, the urging member 3 and the valve body 4 are preferably molded integrally.

The check valve 1 is what is made by fixing the valve member 6 to the cylindrical member 8 in such a manner that the urging member 3 and the valve body 4 are incorporated in the cylindrical member 8. The check valve 1 is inserted into a pourer (a reinforcing casing 20 that will be described later) that is attached to an end portion of a vessel main body in such a manner that the valve body 4 faces a vessel main body side.

Hereinafter, respective components of the check valve 1 will be described in detail.

As shown in FIG. 1(*a*), a flow path F1 is provided inside the spout member 2. In the flow path F1, one end opens to an outer end portion of the spout member 2, and the other end opens to an inner end portion of the spout member 2. The opening at the outer end portion becomes a pouring port 2*a* of the vessel.

In this way, the pouring port 2*a* of the vessel is provided at the outer end portion of the spout member 2. Further, in the outer end portion, the one end of the flow path F1 is configured to open as the pouring port 2*a* of the vessel.

Further, as shown in FIG. 2(*a*), a concave portion 2*b* and a concave portion 2*c* both of which are ring-shaped are provided on an outer circumferential face of the spout member 2. The concave portion 2*b* engages with a convex portion 10 provided on an inner circumferential face of the cylindrical member 8 as shown in FIG. 1(*a*). Thereby, the spout member 2 is fitted into the cylindrical member 8. The concave portion 2*c* is fitted onto a convex portion 22 provided on an inner circumferential face of the reinforcing casing (spout) 20 which will be described later (see FIG. 5). Thereby, the check valve 1 is fitted into the reinforcing casing 20.

The urging member 3 is formed of an elastic material, and is a member for closing a valve by pressing the valve body 4 to a valve seat portion 7. As shown in FIG. 1(*a*) and FIG. 2(*a*), the urging member 3 has a base end portion 3*a* supported by the inner end portion of the spout member 2. Further, a tip end portion 3*b* of the urging member 3 is connected to a top surface of the valve body 4.

The urging member 3 is configured by a coil spring, for example, as shown in FIG. 1(*a*) and FIG. 2(*a*). Besides the coil spring, the urging member 3 may be configured by one or more of columnar or plate-shaped elastic member, or may be configured as what is made by combining a plurality of coil springs in a multiple coil shape.

Note that from a viewpoint of preventing corrosion by a content of the vessel, the urging member 3 is preferably formed from a resin.

As shown in FIG. 1(*a*) and FIG. 2(*a*), the valve body 4 is connected to the tip end portion 3*b* of the urging member 3. The valve body 4 is provided at a position separated from the pouring port 2*a* by at least a length of the urging member 3.

A diameter of the valve body 4 is smaller than a diameter of a flow path F2 in the cylindrical member 8. As the diameter of the valve body 4 is smaller, the content more easily passes through the valve body 4 when the valve is opened. Consequently, the diameter of the valve body 4 is determined in accordance with a kind of the content, a desired outflow velocity and the like.

Note that a shape of the valve body 4 is not limited to a shape of a top shown in FIG. 1(*a*), but may be any shape in which the valve body 4 is seated on the valve seat portion 7 of the cylindrical member 8 to be capable of hermetically sealing (seal).

The cylindrical member 8 is a cylindrical member which is internally provided with the flow path F2. As shown in FIG. 1(*a*) and FIG. 2(*b*), the valve seat portion 7 on which the valve body 4 is seated to be capable of hermetically sealing is provided on an inner circumferential face 8*a* of the cylindrical member 8. The aforementioned valve body 4 is seated on a seat face 7*a* of the valve seat portion 7.

Note that in FIG. 2(*b*), the valve seat portion 7 is provided in a vicinity of a lower end of the cylindrical member 8, but the present invention is not limited to this. For example, the valve seat portion 7 may be provided in a vicinity of a center in the central axis CA direction of the cylindrical member 8, for example.

Further, although the seat face 7*a* is configured as an inclined plane of a conical shape in FIG. 1(*a*), the present invention is not limited to this. That is, the seat face 7*a* can be in a shape in which a gap between the valve body 4 and the valve seat portion 7 is eliminated in a state where the valve body 4 is seated on the valve seat portion 7.

As shown in FIG. 1(*a*) and FIG. 1(*b*), the spout member 2 is fixedly attached to the cylindrical member 8 in such a manner that the valve body 4 and the urging member 3 are inserted into the cylindrical member 8, and the valve body 4 is urged to the valve seat portion 7 by the urging member 3. The concave portion 2*b* of the spout member 2 and the convex portion 10 of the cylindrical member 8 are fitted, whereby the spout member 2 is fitted into the cylindrical member 8.

In a state where the spout member 2 is fixedly attached to the cylindrical member 8, the urging member 3 becomes shorter than a natural length, and the valve body 4 abuts on the seat face 7*a* of the valve seat portion 7 by the urging force of the urging member 3.

In this way, in the check valve 1, the valve body 4 abuts on the seat face 7*a* of the valve seat portion 7 by the urging force of the urging member 3, whereby the valve is brought into a closed state, and sealing performance of the vessel is ensured.

When a vessel main body is pressed by hand and the internal pressure of the vessel rises to surpass the urging force of the urging member 3, the valve body 4 separates from the seat face 7*a* of the valve seat portion 7, and flow of the content is enabled.

As is understood from the above explanation, the check valve 1 is configured as what allows only flow from the vessel main body to the pouring port, with respect to the content in the vessel.

Further, as shown in FIG. 1(*a*), in the state where the spout member 2 is fixedly attached to the cylindrical member 8, the flow path F1 of the spout member 2 and the flow path F2 of the cylindrical member 8 communicate with each other, and configure a flow path F through which the content in the vessel flows out.

Here, a material composing the check valve 1 will be described. The valve member 6 (the spout member 2, the urging member 3 and the valve body 4) and the cylindrical member 8 are formed from a resin, for example. In this case, as an applicable material, polyolefin such as a low density polyethylene (LDPE), a middle density polyethylene (MDPE), a high density polyethylene (HDPE) and a linear low density polyethylene (L-LDPE), and a polypropylene (PP) is cited. Besides, an elastomer such as a silicon rubber is applicable in accordance with a use purpose.

Generally speaking, a material that satisfies required material characteristics (hardness, a bending modulus of elasticity, a heat-resistant temperature, and the like) is selected as the material composing the check valve 1, in accordance with dimensions, a kind of content, presence or absence of disinfection (heating) and the like.

Further, the material composing the urging member 3 is preferably selected in accordance with a required discharge strength (a force necessary to pour the content). When the shape of the urging member 3 is the same, the discharge strength is proportional to the bending modulus of elasticity of the material composing the urging member 3. That is, when the urging member 3 is formed from a material with a high bending modulus of elasticity (that is, a hard material), the discharge strength is large, and when the urging member 3 is formed from a material with a low bending modulus of elasticity (that is, a soft material) on the contrary, the discharge strength is small.

However, when the urging member 3 is formed by using a material with a low bending modulus of elasticity to decrease the discharge strength, sealing performance by the valve tends to decrease. Consequently, the discharge strength may be adjusted by adjusting diameters of the cylindrical member 8 and the valve body 4 (increasing the diameters, for example).

Note that when the content is edible oil or the like, and has a high viscosity, the discharge strength also becomes large. Consequently, the material of the urging member 3 is preferably selected with consideration also given to a characteristic such as the viscosity of the content.

As is understood from the above described explanation, in the check valve 1 according to the present embodiment, the urging member 3 is disposed at a pouring port 2*a* side (that is, a downstream side in the flow path F) from the valve body 4. Consequently, in a state where the valve is closed, the urging member 3 is shut off from the content.

Consequently, components (salt, sugar or the like) included in the content is prevented from depositing on the urging member 3 and a periphery of the urging member 3. For example, even when the check valve 1 is attached to a side portion or a bottom portion of a vessel main body, or even when the check valve 1 is attached to a ceiling portion of the vessel main body and the vessel is used or stored horizontally or with bottom up, the components in the content are prevented from depositing on the urging member 3. As a result, the content can be normally poured, and the check valve function of keeping sealing performance of the vessel can be kept when the content is not poured.

In this way, according to the present embodiment, reduction in the check valve function by deposition of the content can be prevented as much as possible.

Furthermore, in the check valve 1, the content passing through the valve body 4 is rectified by the outflow path F of a length of the length of the urging member 3 or longer. Consequently, when the valve is opened, the content can be prevented from suddenly spattering from the pouring port 2*a*. Consequently, according to the present embodiment, the check valve capable of easily pouring the content into a desired pouring destination can be provided.

Further, in the check valve 1, no spool (shaft portion) is present as in the conventional check valve, and therefore, flexibility of movement can be given to the valve body 4. For example, when the internal pressure of the vessel is applied to the valve body 4, the valve body 4 separates from the valve seat portion 7 in a state opened at one side, whereby the content can be discharged to a downstream side in the outflow path F. Consequently, according to the present embodiment, content discharge performance can be enhanced.

Further, in the check valve 1, no spool (shaft portion) for transmitting the urging force of the urging member 3 to the valve body 4 is present. Therefore, according to the present embodiment, the check valve with the simple configuration can be provided. Because the configuration is simple, manufacturability can be enhanced. Further, a sectional area of the outflow path F is not decreased due to a spool, and therefore, reduction of an outflow amount and an outflow velocity of the content can be avoided.

Further, when the spout member 2, the urging member 3 and the valve body 4 are integrally molded, the check valve 1 can be configured by only two members that are the valve member 6 and the cylindrical member 8, and the check valve 1 can be produced by only fixing the valve member 6 to the cylindrical member 8. Consequently, according to the present embodiment, manufacture cost of the check valve can be reduced, and manufacturability of the check valve can be improved.

Note that in order to allow the valve body 4 to stably abut on the seat face 7*a* of the valve seat portion 7, a guided portion 5 and a guide portion 9 may be provided respectively at the valve body 4 and the cylindrical member 8.

As shown in FIG. 1(*a*), the valve body 4 has the guided portion 5 at an upstream side in the outflow path F. The guided portion 5 is provided to restrict movement of the valve body 4. The guided portion 5 is configured by three plate-shaped members extending radially from a center point of the valve body 4, as shown in FIG. 1(*b*), for example.

Note that the guided portion 5 may be configured by a cylindrical member that is provided at the upstream side in the outflow path F, and has an opening formed at one or more spots on a circumferential face. In this case, at a time of the valve body 4 separating from the seat face 7*a*, the content passes through the opening on the circumferential face from an inner side of the cylindrical member to a direction of an outer side, and further passes through a gap between the valve body 4 and the valve seat portion 7 to get out to an upper side (a downstream side in the outflow path F) of the valve body 4.

With respect to the valve body 4 having the above described guided portion 5, the cylindrical member 8 has the guide portion 9 that causes the guided member 5 to slide in a central axis CA direction of the valve body 4, at the upstream side in the outflow path F of the valve seat portion 7. The guide portion 9 is configured as a small diameter portion of the cylindrical member 8 as shown in FIG. 1(*a*), for example. As shown in FIG. 1(*a*) and FIG. 1(*b*), outer side ends of the plate-shaped members of the guided portion 5 slide on an inner circumferential face of the small diameter portion of the cylindrical member 8.

By providing the guided portion 5 and the guide portion 9 described above, the valve body 4 moves in the central axis CA direction when the valve body 4 receives the internal pressure of the vessel. Consequently, the valve body 4 can be caused to stably abut on the seat face 7*a* of the valve seat portion 7 without providing a spool (a shaft portion) at the valve body 4.

Next, with reference to FIG. 3, check valves according to a first and a second modification examples of the present invention will be described.

(First Modification Example of Check Valve)

Figure 3:
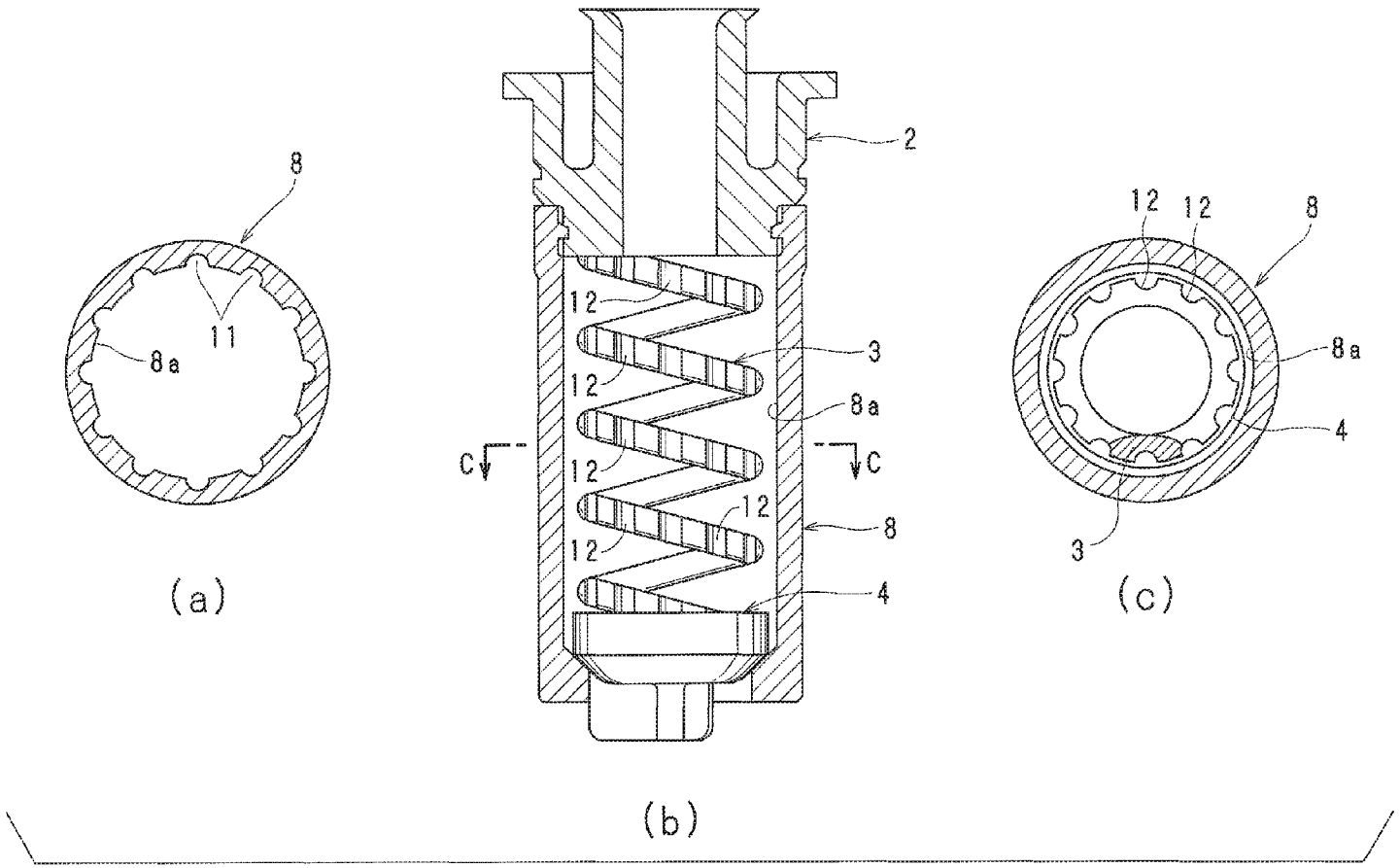
FIG. 3(*a*) is an end view of a cylindrical member of a check valve according to a first modification example of the present invention, FIG. 3(*b*) is a partial sectional view of a check valve according to a second modification example of the present invention, and FIG. 3(*c*) is a sectional view along a line C-C in FIG. 3(*b*).

With reference to FIG. 3(*a*), the first modification example will be described. FIG. 3(*a*) is an end view of the cylindrical member 8 of the check valve according to the first modification example. In more detail, FIG. 3(*a*) is the end view of the cylindrical member 8 in a case where the cylindrical member 8 is cut by a plane orthogonal to the central axis CA of the cylindrical member 8 according to the modification example.

In the first modification example, a plurality of grooves 11 are provided on the inner circumferential face 8*a* of the cylindrical member 8. These grooves 11 extend parallel with the central axis CA of the cylindrical member 8, and rectify a flow of a content flowing in the outflow path F.

Thereby, the content can be further prevented from suddenly spattering from the pouring port when the valve is opened, and the content can be more easily poured into a desired pouring destination.

(Second Modification Example of Check Valve)

With reference to FIGS. 3(*b*) and 3(*c*), the second modification example will be described. FIG. 3(*b*) is a partial sectional view of a check valve according to the second modification example. In FIG. 3(*b*), the spout member 2 and the cylindrical member 8 are shown in a sectional view, and the other components are shown in a side view. FIG. 3(*c*) is a sectional view along a line C-C in FIG. 3(*b*).

In the second modification, a plurality of grooves 12 are provided on a surface of the urging member 3. These grooves 12 extend parallel with the central axis CA of the cylindrical member 8, and rectify a flow of a content flowing in the outflow path F.

Thereby, the content can be further prevented from suddenly spattering from the pouring port when the valve is opened, and the content can be more easily poured into a desired pouring destination.

Note that as shown in FIGS. 3(*b*) and 3(*c*), the grooves 12 are preferably provided to correspond to one another, seen from the central axis CA direction.

As is understood from the above described two modification examples, by providing the rectifying portion including the grooves or ribs that rectify the flow of the content flowing in the outflow path F, on the inner circumferential face 8*a* of the cylindrical member 8 or the surface of the urging member 3, the content can be further prevented from spattering from the pouring port when the valve is opened, and content pouring performance can be enhanced.

Note that both of the grooves 11 and the grooves 12 may be provided by combining the first modification example and the second modification example. Further, in place of the grooves 11 and 12, or with the grooves 11 and 12, ribs may be provided.

Further, although the grooves 12 are provided on the surface on the outer side of the urging member 3 in FIGS. 3(*b*) and 3(*c*), grooves or ribs may be formed on the surface on an inner side of the urging member 3.

(Third Modification Example of Check Valve)

Figure 4:
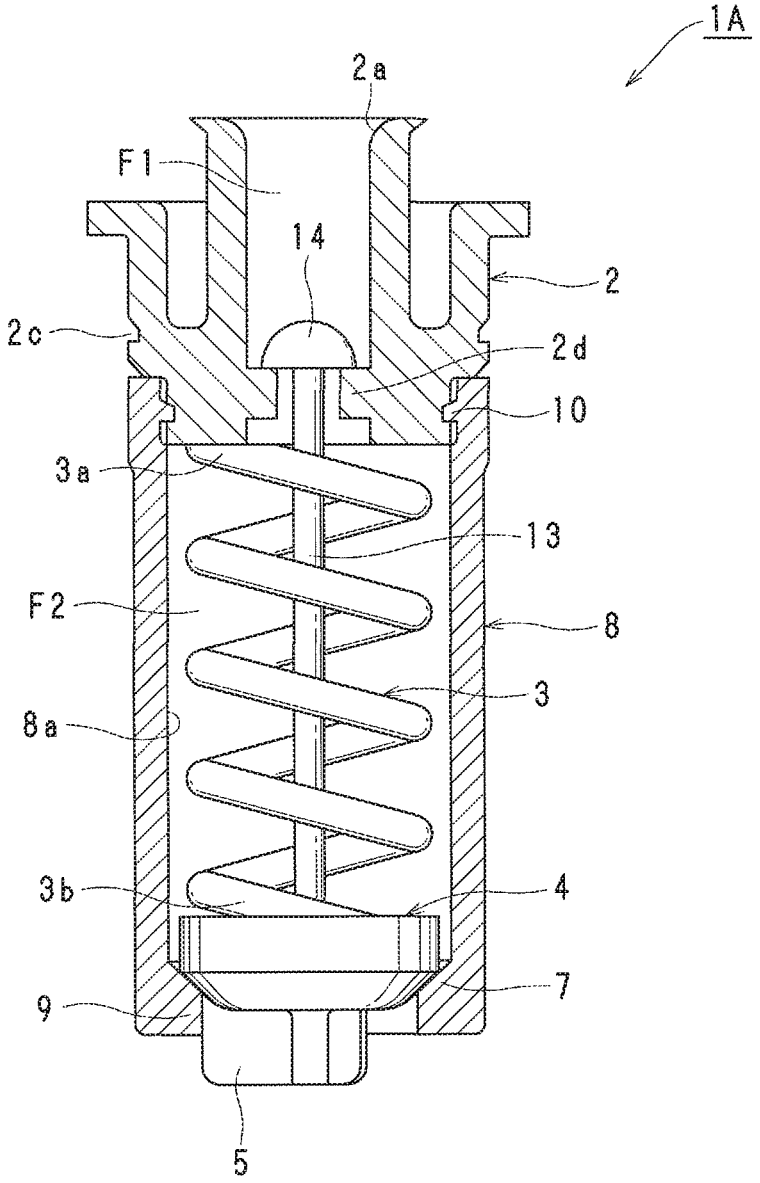
FIG. 4 is a partial sectional view of a check valve according to a third modification example of the present invention.

Next, with reference to FIG. 4, a check valve 1A according to a third modification example of the present invention will be described. FIG. 4 is a partial sectional view of the check valve 1A. In FIG. 4, the spout member 2 and the cylindrical member 8 are shown in a sectional view, and the other components are shown in a side view.

As shown in FIG. 4, in the check valve 1A according to the present modification example, a spool (a shaft portion) 13 is provided at a downstream side in the outflow path F, of the valve body 4. The spool 13 extends to the flow path F1 in the spout member 2 from the valve body 4.

Further, a bulged portion 14 is formed at a tip end of the spool 13, and a small diameter portion 2*d* is formed on the inner circumferential face of the spout member 2.

In a state where the valve body 4 is seated on the valve seat portion 7 (that is, when the check valve is closed), the bulged portion 14 is locked to the small diameter portion 2*d* and form a sealing portion with the small diameter portion 2*d*, as shown in FIG. 4. Thus, the content remaining in the flow path F1 in the spout member 2 by being unfinished or the like can be prevented from flowing into the flow path F2 in the cylindrical member 8. In addition, sealing performance of the vessel can be further enhanced.

When the check valve is opened by the internal pressure of the vessel, the bulged portion 14 also moves to the downstream side in the outflow path F in accordance with movement of the valve body 4. That is, when the check valve opens, sealing by the sealing portion is also released. Consequently, the content which flows in from the vessel main body passes through the outflow path F to be poured from the pouring port 2*a*.

As described above, according to the present modification example, the content remaining in the flow path F1 in the spout member 2 by being unfinished or the like can be prevented from flowing into the flow path F2 in the cylindrical member 8. As a result, the components of the content can be further restrained from depositing on the urging member. Further, according to the present modification example, sealing performance of the vessel can be further enhanced.

A shape of the above described bulged portion 14 can be a shape capable of forming the sealing portion with the small diameter portion 2*d* by being locked to the small diameter portion 2*d*, and may be a rectangular parallelepiped shape or a pyramid shape, without being limited to a semispherical shape as shown in FIG. 4.

<Check Valve Assembly>

Figure 5:
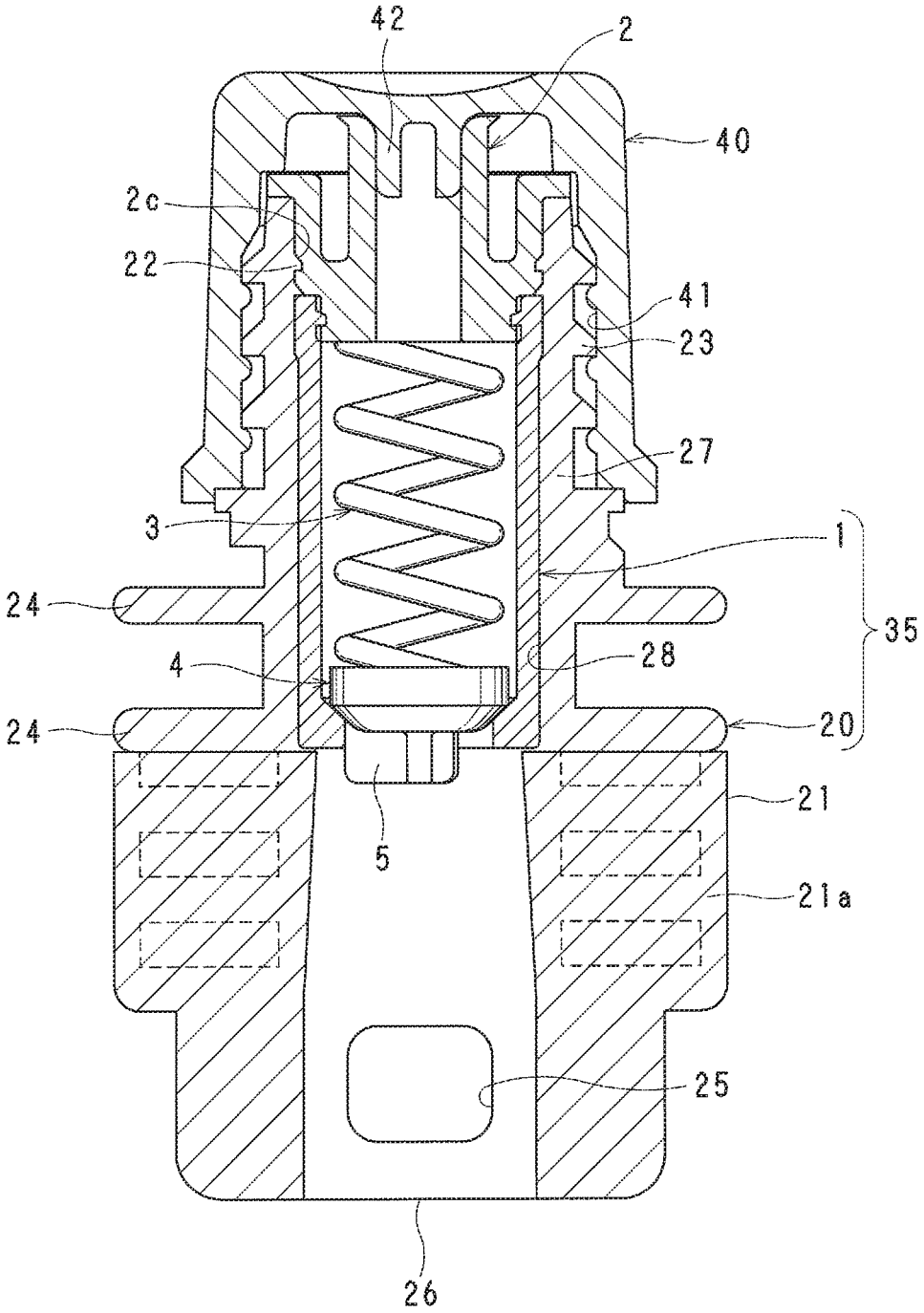
FIG. 5 is a partial sectional view of a check valve assembly according to one embodiment of the present invention, and a cap attached to the check valve assembly.

Next, a check valve assembly 35 according to one embodiment of the present invention will be described with reference to FIG. 5. FIG. 5 is a partial sectional view of the check valve assembly 35 according to the one embodiment, and a cap 40 attached to the check valve assembly 35. Note that in FIG. 5, the urging member 3, the valve body 4 and the guided portion 5 are shown in a side view, and the other components are shown in a sectional view.

The check valve assembly 35 has the check valve 1 and the reinforcing casing (spout) 20, as shown in FIG. 5. Further, to an upper portion of the check valve assembly 35, the cap 40 is attached.

The reinforcing casing 20 is internally provided with a hollow portion 28 in which the cylindrical member 8 is incorporated. As shown in FIG. 5, the check valve 1 is inserted into the hollow portion 28 in the reinforcing casing 20. A convex portion 22 is formed in the hollow portion 28. The concave portion 2*c* of the spout member 2 and the convex portion 22 of the reinforcing casing 20 are fitted to each other, whereby the check valve 1 is fitted (fixedly attached) into the reinforcing casing 20.

The reinforcing casing 20 has a thick-walled port portion 27 that is internally provided with the hollow portion 28, and prevents deformation of the valve seat portion 7. A male screw portion 23 is formed on an outer circumferential face of the port portion 27. As shown in FIG. 5, a flange portion 24 that juts out to outside is formed at a lower side portion of the port portion 27.

The cap 40 has a female screw 41 formed on an inner circumferential face. The cap 40 is attached to the port portion 27 by being screwed onto the male screw portion 23. Further, as shown in FIG. 5, a plug portion 42 in a convex shape is formed inside a ceiling portion of the cap 40. The plug portion 42 plugs the pouring port 2*a* of the spout member 2 in a state where the cap 40 is attached to the port portion 27. Thus, even when the vessel main body is pressed and the valve is opened, the content can be prevented from flowing out from the pouring port 2*a*.

Further, the reinforcing casing 20 has a clamping portion 21 connected to a lower end (a vessel main body side) of the port portion 27. The clamping portion 21 has an overhanging portion that overhangs to a left and a right. An outer surface of the clamping portion 21 configures a seal portion 21*a* that is thermally welded (heat sealing) to the vessel main body.

As shown in FIG. 5, a main inflow port 26 opens to an undersurface of the clamping portion 21, and an auxiliary inflow port 25 opens to a side surface of the clamping portion 21. The content in the vessel flows into the hollow portion 28 of the reinforcing casing 20 from the main inflow port 26 and the auxiliary inflow port 25.

Note that a shape of the reinforcing casing 20 is not limited to the cylindrical shape as shown in FIG. 5, but may be an L-shape having a bended portion, for example.

Further, the reinforcing casing 20 is formed from a resin, for example. In this case, as an applicable material, polyolefin such as a low density polyethylene (LDPE), a middle density polyethylene (MDPE), a high density polyethylene (HDPE) and a linear low density polyethylene (L-LDPE), and a polypropylene (PP) is cited.

Generally speaking, a material that satisfies required material characteristics (hardness, a heat-resistant temperature, and the like) is selected as the material composing the reinforcing casing 20, in accordance with the dimensions of the reinforcing casing, the kind of content, presence or absence of disinfection (heating) and the like.

(Modification Example of Check Valve Assembly)

Figure 6:
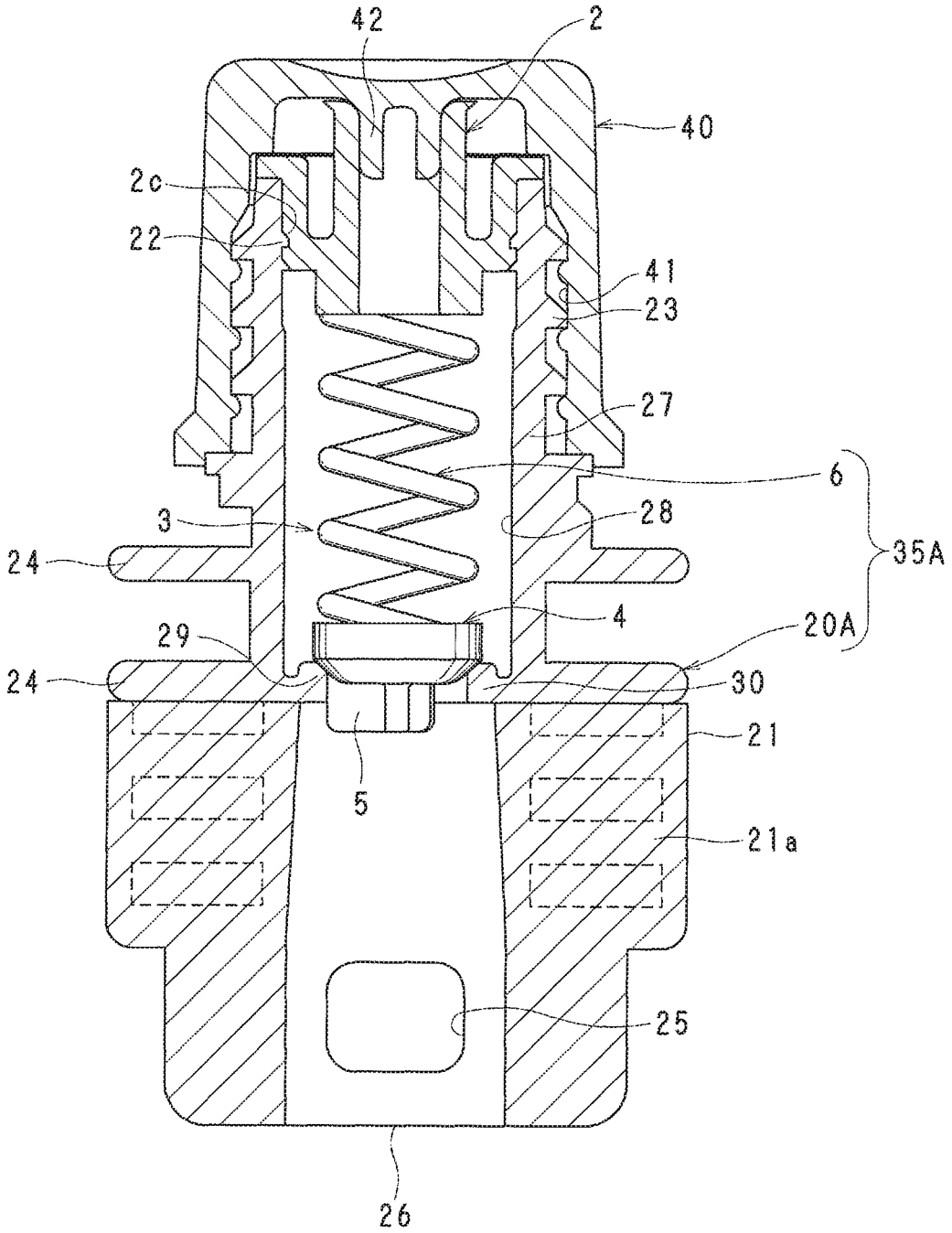
FIG. 6 is a partial sectional view of a check valve assembly according to a modification example of the present invention, and a cap attached to the check valve assembly.

Next, with reference to FIG. 6, a check valve assembly 35A according to a modification example of the present invention will be described. FIG. 6 shows a partial sectional view of a check valve assembly 35A according to the present modification, and the cap 40 attached to the check valve assembly 35A.

As shown in FIG. 6, in the present modification example, the check valve assembly 35A is what is made by fixing the valve member 6 to a reinforcing casing 20A. The spout member 2 is fitted into the reinforcing casing 20A by the concave portion 2*c* being fitted onto the convex portion 22 formed on an inner circumferential face of the reinforcing casing 20A.

Further, a ring-shaped valve seat portion 29 is provided on the inner circumferential face of the reinforcing casing 20A. The urging member 3 urges the valve body 4 to the valve seat portion 29, and the valve body 4 is seated on the valve seat portion 29 to be capable of hermetically sealing.

Note that a guide portion having a similar function to the function of the aforementioned guide portion 9 may be provided at the reinforcing casing 20A. That is, the reinforcing casing 20A may have a guide portion 30 that causes the guided member 5 to slide along the central axis of the valve body 4, at the upstream side (vessel main body side) in the outflow path F, of the valve seat portion 29. The guide portion 30 is a small diameter portion which is formed in the hollow portion 28 of the reinforcing casing 20A, for example, as shown in FIG. 6.

As described above, the check valve assembly 35A according to the present modification example is configured by two components that are the valve member 6 and the reinforcing casing 20A. Speaking by comparison with the aforementioned check valve assembly 35, the check valve assembly 35A of the present modification example also can be grasped as what is made by integrally molding the reinforcing casing 20 of the check valve assembly 35 and the cylindrical member 8. In other words, the reinforcing casing 20A has the function of the aforementioned cylindrical member 8.

According to the present modification example, the number of components can be reduced, and therefore, improvement of manufacturing efficiency and reduction in cost can be enabled.

<Vessel Equipped with Check Valve>

Figure 7:
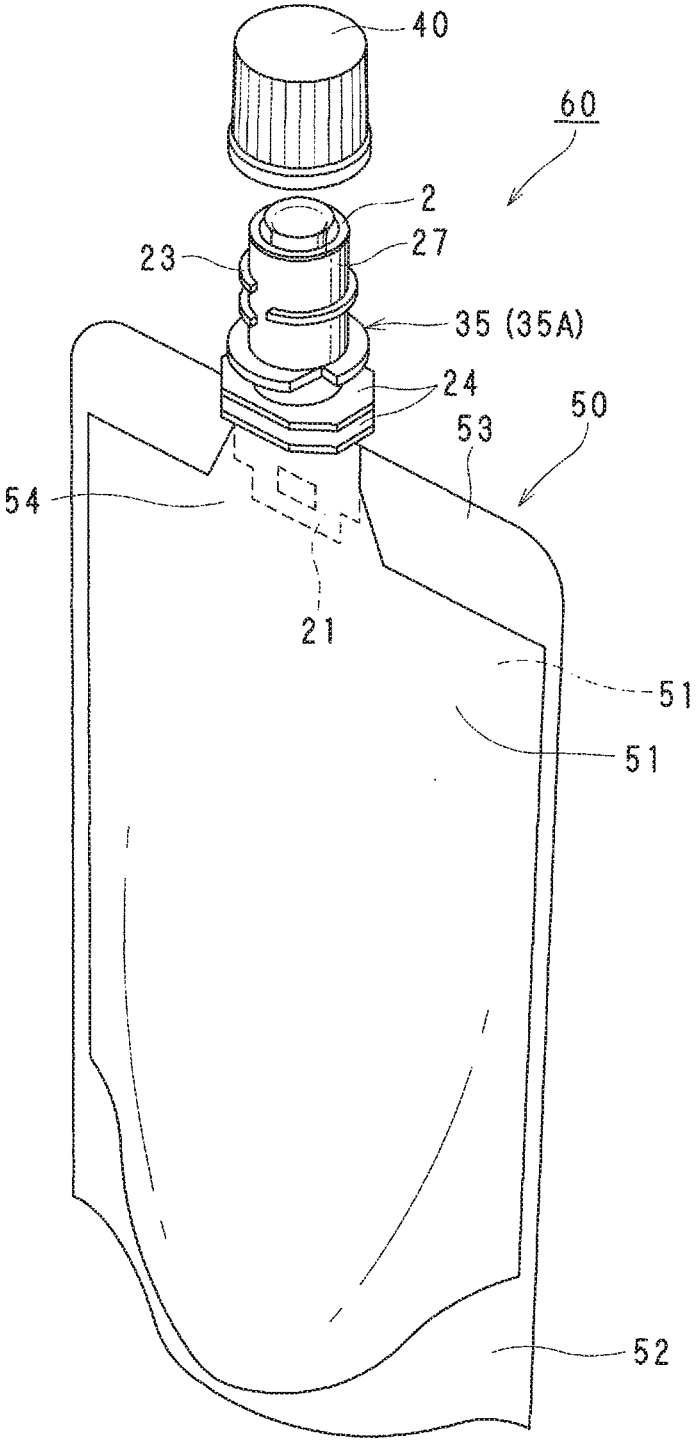
FIG. 7 is a perspective view of a vessel equipped with the check valve according to one embodiment of the present invention.

Next, with reference to FIG. 7, a vessel 60 equipped with the check valve according to one embodiment of the present invention will be described. FIG. 7 shows a perspective view of the vessel 60 equipped with the check valve.

As shown in FIG. 7, the vessel 60 equipped with the check valve includes the check valve assembly 35 (35A) and a vessel main body 50.

The vessel main body 50 is configured to be able to contain a content, and the check valve assembly 35 is attached to a pouring portion 54.

The vessel main body 50 is a self-supporting type standing pouch (a bottom gusset bag), for example, as shown in FIG. 7. However, the vessel main body 50 may be a butt-seam bag (a pillow bag), a three side sealed bag, a four side sealed bag (a flat pouch), a side gusset bag or the like, without being limited to a bottom gusset bag. Speaking more generally, the vessel main body 50 can be a vessel main body in which the internal pressure in the vessel is increased by pressing the vessel main body by hand, and may be a blow molded bottle, a PET bottle, a paper carton or the like.

The vessel main body 50 shown in FIG. 7 is configured by a pair of planar portions 51 facing each other, a bottom face portion (not illustrated) that is bonded to the planar portions 51 at bottom portions of the planar portions 51.

The respective planar portions 51 are formed into rectangular shapes, and side edges of both of them are bonded to each other by thermal welding. Further, the bottom face portion has a peripheral edge thereof bonded to inner faces of the respective planar portions 51 by thermal welding, and closes a bottom portion of the vessel main body 50. A lower end portion 52 where the planar portions 51 are bonded to the bottom face portion functions as a leg portion for allowing the vessel 60 equipped with the check valve to stand on its own.

In an upper end portion 53 of the vessel main body 50, the clamping portion 21 of the reinforcing casing (pourer) 20 is sandwiched by the planar portions 51. The outer surface of the clamping portion 21 is the seal portion 21*a* which is bonded to the vessel main body 50 by thermal welding.

In more detail, the check valve assembly 35 is attached to the pouring portion 54 of the vessel main body 50 by the clamping portion 21 of the reinforcing casing 20 being thermally welded to the flat portions 51 at the upper end portion 53 of the vessel main body 50.

Note that a method for attaching the check valve assembly 35 to the vessel main body 50 is not limited to thermal welding, and it is also possible to use known bonding methods (ultrasonic sealing, high-frequency sealing, impulse sealing and the like).

In the example shown in FIG. 7, the check valve assembly 35 is attached to a center of a ceiling portion of the vessel main body 50 in such a manner that the port portion 27 of the reinforcing casing 20 protrudes from the upper end portion 53 of the vessel main body 50.

An attaching position of the check valve assembly 35 to the vessel main body 50 is not limited to the ceiling portion (a top seal portion) of the vessel main body, but may be properly changeable in accordance with a use purpose. That is the check valve assembly 35 may be attached to a proper position (a side seal portion, a bottom seal portion, a shoulder seal portion, or the like) in the vessel main body.

Next, a method for attaching the reinforcing casing (pourer) 20 to the vessel main body 50, and filling a content will be described. First, the reinforcing casing 20 is inserted into the pouring portion (the opening portion) 54 of the vessel main body 50 up to the clamping portion 21. Next, the pouring portion 54 in which the clamping portion 21 is inserted is clamped with a pair of heat plates (heat sealing bars) to be heated. Thereafter, a cooling process is performed, and the reinforcing casing 20 is fixed to the vessel main body 50.

After the reinforcing casing 20 is fixed to the vessel main body 50, a content is filled into the vessel main body 50 via the hollow portion 28 of the reinforcing casing 20. After filling of the content is finished, the check valve 1 is fitted into the reinforcing casing 20 to form the check valve assembly 35. Thereafter, the cap 40 is attached to the check valve assembly 35.

Note that in the above described method, before filling the content, the check valve 1 may be attached into the reinforcing casing 20 to form the check valve assembly 35. In this case, a portion (a filling port) where thermal welding is not performed is provided in the vessel main body 50 in advance, and after the check valve assembly 35 is formed, a filling nozzle is inserted into the filling port, whereby filling of the content is performed.

A use method of the above described vessel 60 equipped with the check valve is similar to the conventional vessel with a check valve. That is, at the time of pouring the content, the vessel main body 50 is pressed with hand, and the internal pressure of the vessel main body 50 is increased. Thereby, the valve body 4 moves to the pouring port 2*a* side against the urging force of the urging member 3, and the content is poured from the pouring port 2*a* of the spout member 2. At the time of stopping pouring of the content, pressing the vessel main body 50 is stopped, and the internal pressure of the vessel main body 50 is reduced. Thereby, the urging force of the urging member 3 surpasses the force by the internal pressure of the vessel main body 50, and the valve body 4 is seated on the valve seat portion to close the valve.

On the basis of the above described explanation, a person skilled in the art could conceive of additional effects and various modifications of the present invention, however, the mode of the present invention is not limited to the aforementioned individual embodiment and modification examples. The components in all the different embodiment and modification examples may be arbitrarily combined. Various additions, changes and partial deletions can be made within the range without departing from the conceptual idea and gist of the present invention derived from the contents defined in the claims and the equivalents thereof.

REFERENCE SIGNS LIST

1, 1A Check valve
2 Spout member
2*a* Pouring port
2*b*, 2*c* Concave portion
2*d* Small diameter portion
3 Urging member
3*a* Base end portion
3*b* Tip end portion
4 Valve body
5 Guided portion
6 Valve member
7 Valve seat portion
7*a* Seat face
8 Cylindrical member
8*a* Inner circumferential face
9 Guide portion
10 Convex portion
11, 12 Groove
13 Spool
14 Bulged portion
20, 20A Reinforcing casing
21 Clamping portion
21*a* Seal portion
22 Convex portion
23 Male screw portion
24 Flange portion
25 Auxiliary inflow port
26 Main inflow port
27 Port portion
28 Hollow portion
29 Valve seat portion
30 Guide portion
35, 35A Check valve assembly
40 Cap
41 Female screw
42 Plug portion
50 Vessel main body
51 Planar portion
52 Lower end portion
53 Upper end portion
54 Pouring portion
60 Vessel equipped with check valve
F1, F2 Flow path
F Outflow path
CA Central axis

What is claimed is:

1. A check valve comprising a valve member including a spout member with a pouring port of a vessel provided at an outer end portion, an urging member with a base end portion supported by an inner end portion of the spout member, and a valve body connected to a tip end portion of the urging member, and a cylindrical member with a valve seat portion on which the valve body is seated to be capable of hermetically sealing provided on an inner circumferential face, inside the spout member, a first flow path in which a content in the vessel flows being provided, inside the cylindrical member, a second flow path through which the content in the vessel flows being provided, and the first flow path and the second flow path communicating with each other to configure an outflow path through which the content in the vessel flows out, and the spout member being fixedly attached to the cylindrical member so that the valve body and the urging member are inserted into the cylindrical member, and the valve body is urged to the valve seat portion by the urging member, wherein the valve body has a guided portion that restricts movement of the valve body, at an upstream side in the outflow path, the cylindrical member has a guide portion that causes the guided portion to slide in a central axis direction of the valve body, at an upstream side in the outflow path, of the valve seat portion, and the guided portion slides on the inner circumferential face of a small diameter portion of the cylindrical member.

2. The check valve according to claim 1, wherein the spout member, the urging member and the valve body are integrally molded.

3. A check valve assembly, comprising:

the check valve according to claim 1; and a reinforcing casing that prevents deformation of the valve seat portion, the reinforcing casing being internally provided with a hollow portion in which the cylindrical member is incorporated, and having a seal portion that is bonded to a vessel main body, on an outer surface.

4. A vessel equipped with a check valve, comprising:

the check valve assembly according to claim 3; and a vessel main body that contains a content, and has the check valve assembly attached to a pouring portion.

5. The check valve according to claim 1, wherein the content is liquid.

6. The check valve according to claim 1, wherein the guided portion is configured by three plate-shaped members extending radially from a center point of the valve body.

7. The check valve according to claim 1, wherein a rectifying portion is provided on the inner circumferential face of the cylindrical member and/or a surface of the urging member, the rectifying portion includes grooves or ribs and rectifies a flow of the content flowing in the outflow path.

* * * * *